US011342661B2

(12) United States Patent
Chen et al.

(10) Patent No.: US 11,342,661 B2
(45) Date of Patent: May 24, 2022

(54) ANTENNA STRUCTURE AND WIRELESS COMMUNICATION DEVICE USING THE SAME

(71) Applicant: Shenzhen Next Generation Communications Limited, Shenzhen (CN)

(72) Inventors: Kuo-Cheng Chen, New Taipei (TW); Jian-Wei Chang, New Taipei (TW); Zhen-Chang Tang, Shenzhen (CN); Hsiao-Hung Liu, New Taipei (TW); Hsi-Hsing Hsu, New Taipei (TW); Jia Chen, Shenzhen (CN); Yi-Kuo Chen, New Taipei (TW)

(73) Assignee: Mobile Drive Netherlands B.V., Amsterdam (NL)

( * ) Notice: Subject to any disclaimer, the term of this patent is extended or adjusted under 35 U.S.C. 154(b) by 147 days.

(21) Appl. No.: 16/665,305

(22) Filed: Oct. 28, 2019

(65) Prior Publication Data

US 2020/0176862 A1 Jun. 4, 2020

(30) Foreign Application Priority Data

Dec. 4, 2018 (CN) ..... 201811473878.1

(51) Int. Cl.

| | |
|---|---|
| ***H01Q 9/04*** | (2006.01) |
| ***H01Q 9/06*** | (2006.01) |
| ***H01Q 21/00*** | (2006.01) |
| ***H01Q 15/02*** | (2006.01) |

(Continued)

(52) U.S. Cl.

CPC ..... *H01Q 1/521* (2013.01); *H01Q 9/04* (2013.01); *H01Q 9/0407* (2013.01); *H01Q 9/06* (2013.01); *H01Q 9/065* (2013.01); *H01Q 15/02* (2013.01); *H01Q 21/00* (2013.01); *H01Q 21/0025* (2013.01); *H01Q 21/24* (2013.01)

(58) Field of Classification Search

CPC .... H01Q 1/521; H01Q 21/0025; H01Q 21/24; H01Q 9/065; H01Q 9/0407; H01Q 15/02; H01Q 9/04; H01Q 9/06; H01Q 21/00; H01Q 21/205; H01Q 21/09; H01Q 1/52

USPC ..... 343/727

See application file for complete search history.

(56) References Cited

U.S. PATENT DOCUMENTS 8,009,107 B2 * 8/2011 Li ..... H01Q 9/40 343/700 MS
10,003,132 B2 * 6/2018 Du ..... H01Q 5/30

(Continued)

FOREIGN PATENT DOCUMENTS

CN 204029993 U 12/2014
CN 106469854 A 3/2017

(Continued)

*Primary Examiner* — Hai V Tran
(74) *Attorney, Agent, or Firm* — ScienBiziP, P.C.

(57) ABSTRACT

An antenna and antenna module with a structure increasing radio wave coverage but reducing cross interference between modules includes a circuit board in the shape of an octagon and four antenna modules. The circuit board thus includes eight side surfaces, and the four antenna modules are respectively disposed on four non-adjacent side surfaces of the octagon. Each antenna module is electrically connected to the side surface by a feed portion. A wireless communication device using the antenna structure is also disclosed.

18 Claims, 7 Drawing Sheets

(51) Int. Cl.
*H01Q 1/52* (2006.01)
*H01Q 21/24* (2006.01)

(56) References Cited

U.S. PATENT DOCUMENTS

| | | | | |
|---|---|---|---|---|
| 2008/0180333 | A1* | 7/2008 | Martiskainen | H01Q 1/243 343/722 |
| 2014/0118198 | A1* | 5/2014 | Kawashimo | H01Q 1/2266 343/702 |
| 2014/0191918 | A1* | 7/2014 | Cheng | H01Q 21/205 343/834 |
| 2015/0097751 | A1* | 4/2015 | Hsu | H01Q 21/28 343/844 |
| 2016/0181234 | A1* | 6/2016 | Xu | H03F 3/213 438/618 |
| 2016/0347425 | A1* | 12/2016 | Su | G05D 1/0027 |
| 2017/0085007 | A1* | 3/2017 | Wu | H01Q 1/523 |
| 2019/0165473 | A1* | 5/2019 | Yun | H01Q 1/243 |

FOREIGN PATENT DOCUMENTS

| | | | |
|---|---|---|---|
| CN | 106549216 | A | 3/2017 |
| CN | 207938797 | U | 10/2018 |
| TW | 201712952 | A | 4/2017 |
| WO | 2015127625 | A1 | 9/2015 |

* cited by examiner

ANTENNA STRUCTURE AND WIRELESS COMMUNICATION DEVICE USING THE SAME

FIELD

The subject matter relates to antennas.

BACKGROUND

A printed circuit board (PCB) of a wireless communication product usually has a square design, the millimeter wave antenna module is placed on each of the four sides of the square, and the 2G/3G/4G antennas are placed at the four corners of the square. The placing of a transmission interface close to the millimeter wave antenna on the PCB can affect the transmission and reception of a wireless signal, and will also limit the design of the product.

Therefore there is a room for improvement.

BRIEF DESCRIPTION OF THE DRAWINGS

Implementations of the present disclosure will now be described, by way of embodiments, with reference to the attached figures.

DETAILED DESCRIPTION

Figure 1:
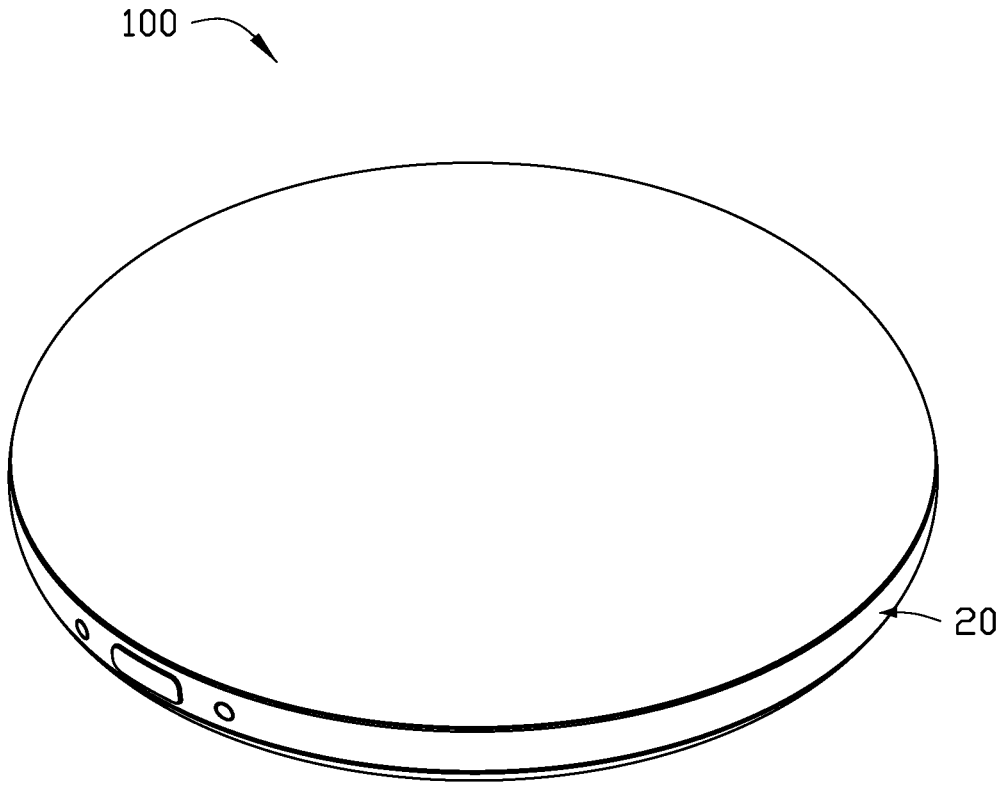
FIG. 1 is a schematic diagram of an embodiment of a wireless communication device.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series, and the like.

Figure 2:
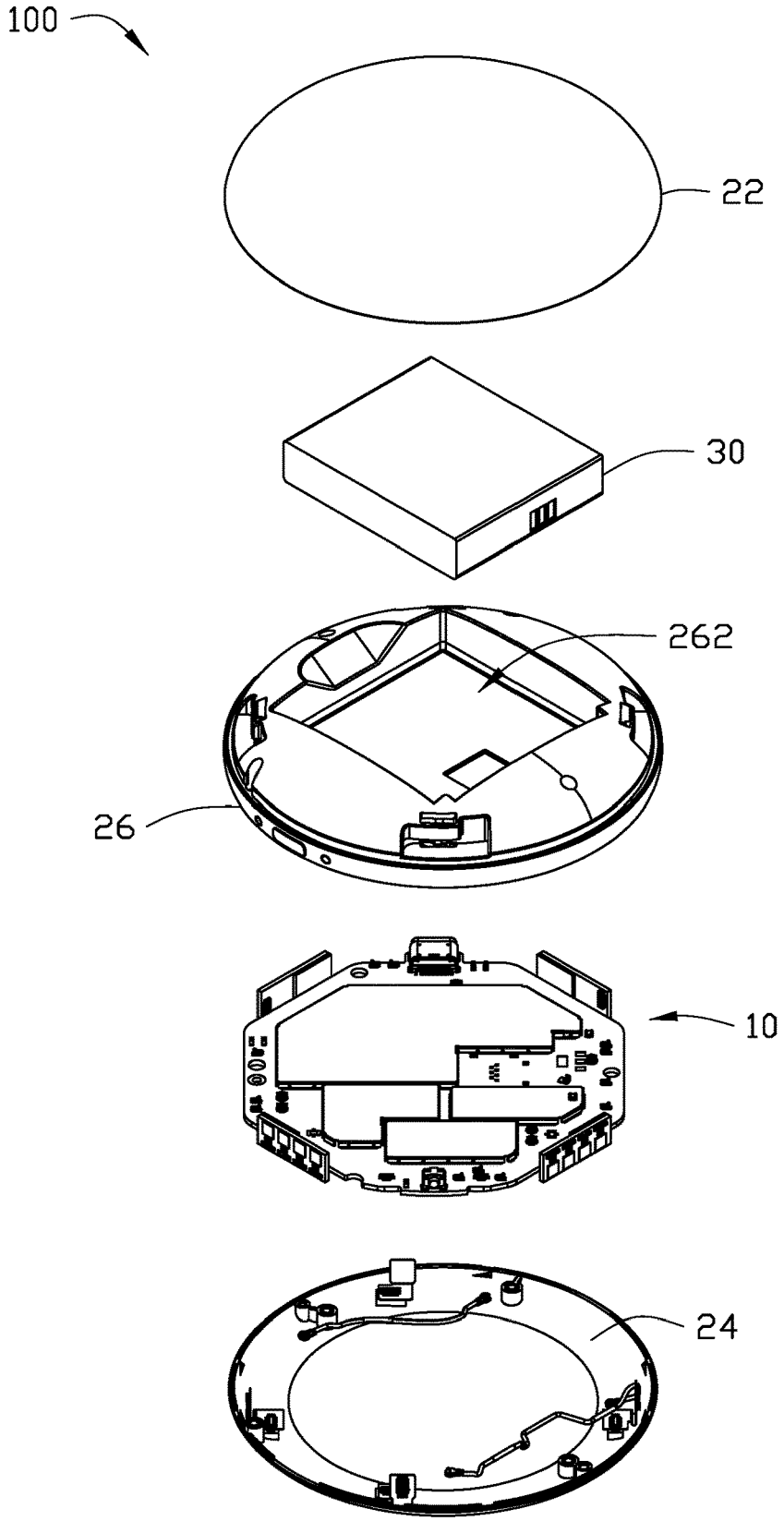
FIG. 2 is an exploded view of an embodiment of a wireless communication device using an antenna structure of the present disclosure.
Figure 3:
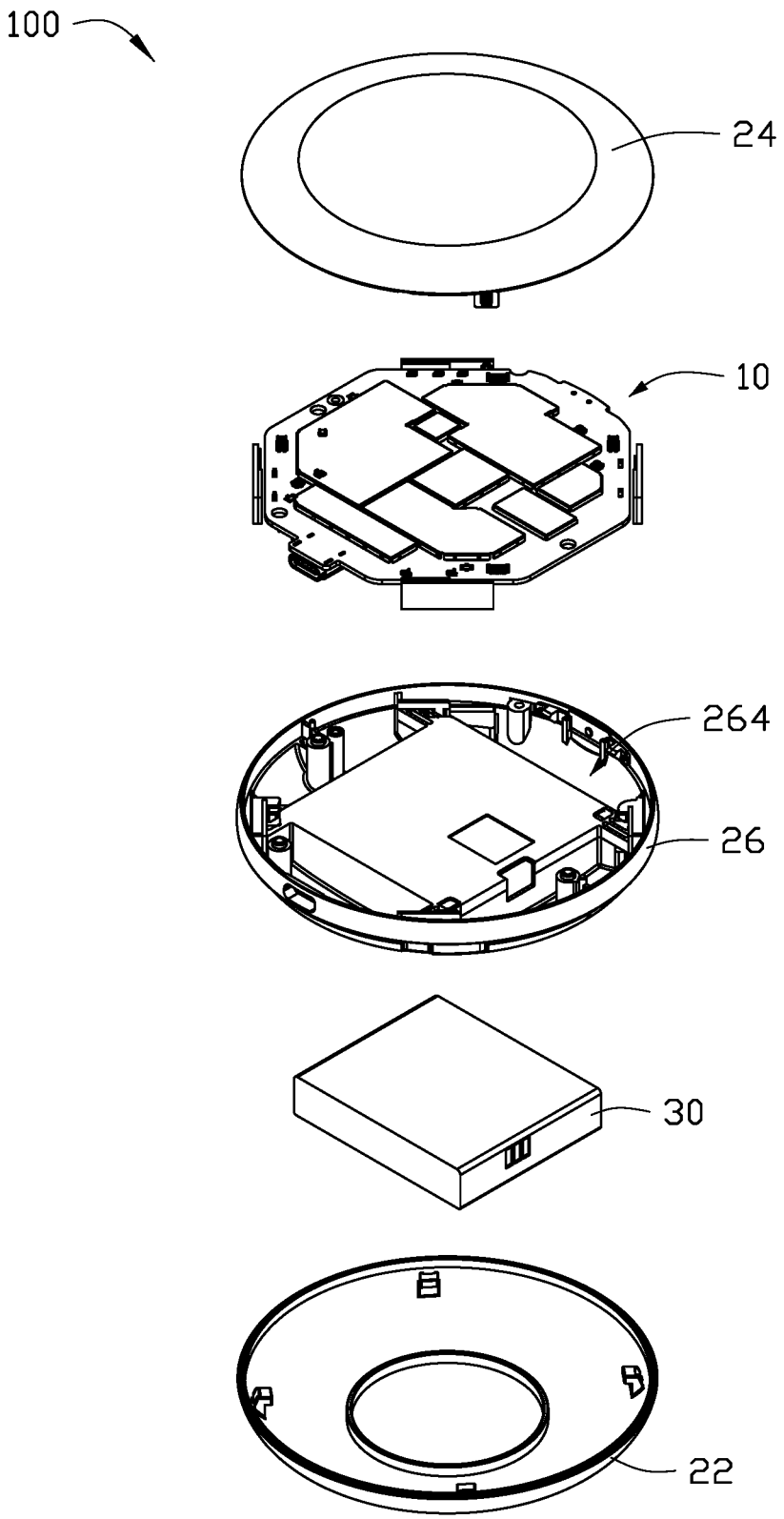
FIG. 3 is an exploded view of the wireless communication device from another angle.

FIGS. 1-3 illustrate a wireless communication device 100 in accordance with an embodiment of the present disclosure. The wireless communication device 100 includes an antenna structure 10, a housing 20, and a battery 30. The wireless communication device 100 can further include, but is not limited to, other structures, electronic components, modules, and software.

In at least one embodiment, the wireless communication device 100 may be a 5G router or a mobile phone, for example. The antenna structure 10 is configured to transmit and receive wireless signals.

The housing 20 includes an upper cover 22, a lower cover 24, and a middle frame 26.

In at least one embodiment, an upper portion of the middle frame 26 defines a first receiving portion 262, and the first receiving portion 262 receives the battery 30. A lower portion of the middle frame 26 defines a second receiving portion 264, and the second receiving portion 264 receives the antenna structure 10.

In at least one embodiment, the upper cover 22 is opposite to the upper portion of the middle frame 26, and the lower cover 24 is opposite to the lower portion of the middle frame 26. Therefore, the antenna structure 10 and the battery 30 can be received in the casing 20.

Figure 4:
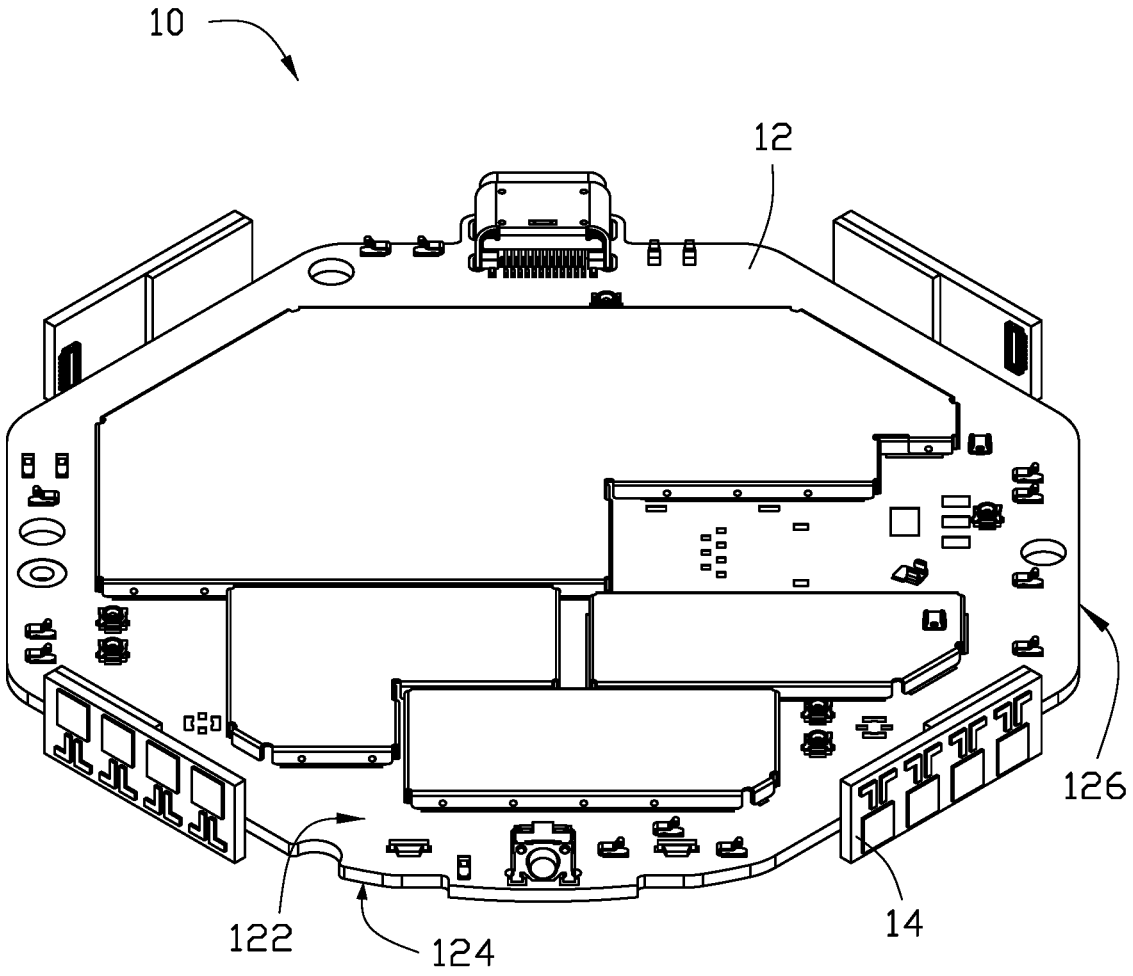
FIG. 4 is a schematic diagram of an embodiment of the antenna structure of FIG. 2.
Figure 5:
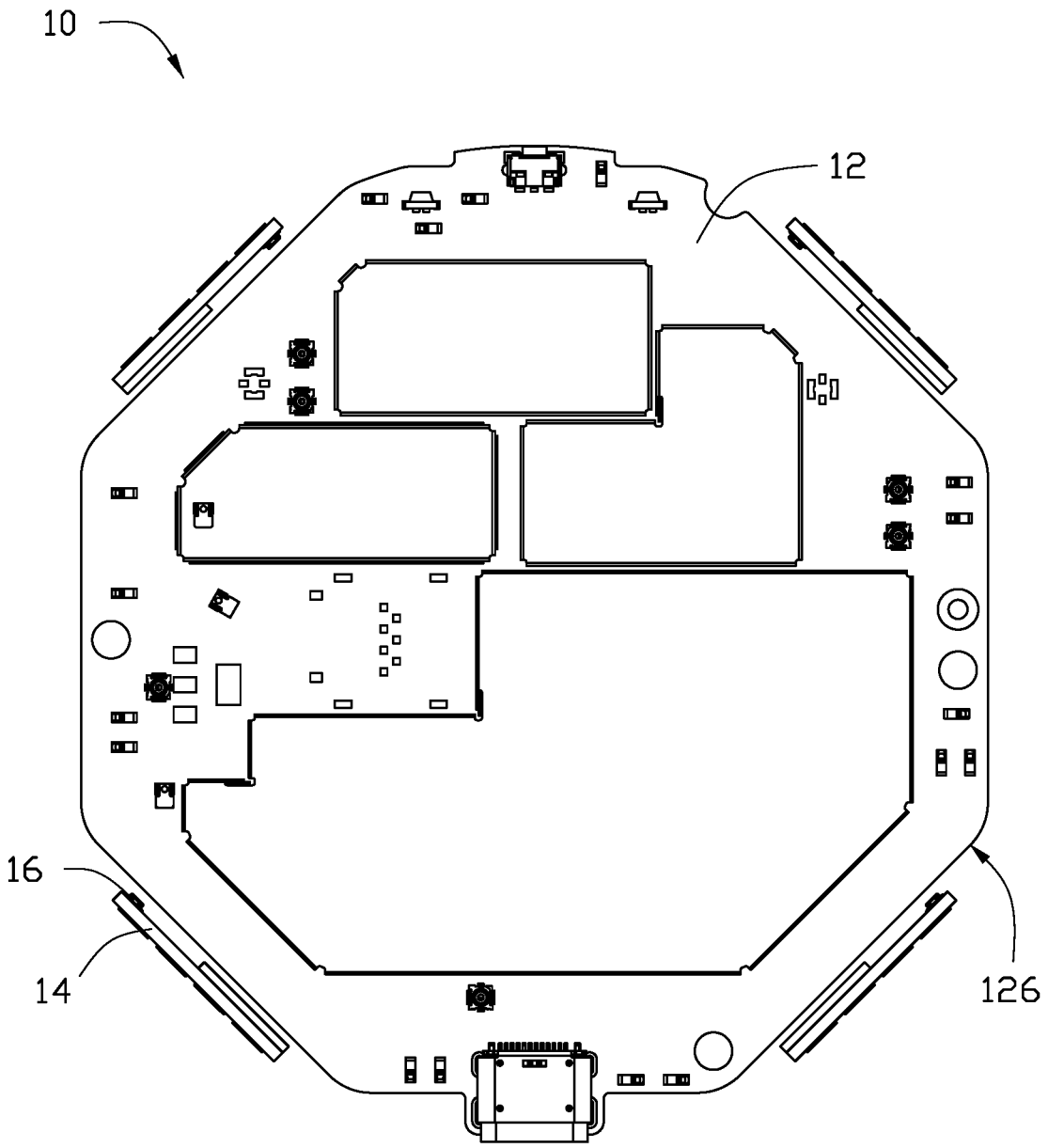
FIG. 5 is a top view of an embodiment of the antenna structure of FIG. 4.

FIGS. 4 and 5 illustrate the antenna structure 10 having an octagonal circuit board 12 and four antenna modules 14.

In at least one embodiment, the octagonal circuit board 12 includes an upper surface 122 and a lower surface 124, and the upper surface 122 is opposite to the lower surface 124.

The octagonal circuit board 12 further includes eight side surfaces 126 that connect to the upper surface 122 and the lower surface 124.

The four antenna modules 14 are respectively disposed on the four side surfaces 126 of the octagonal circuit board 12. The four side surfaces 126 are not adjacent to each other, and each of the antenna modules 14 can be electrically coupled through a feeding portion 16. Each feeding portion 16 is configured to feed a current signal to the antenna module 14.

In at least one embodiment, the feeding portion 16 may be a flexible printed circuit board (FPC).

Figure 6:
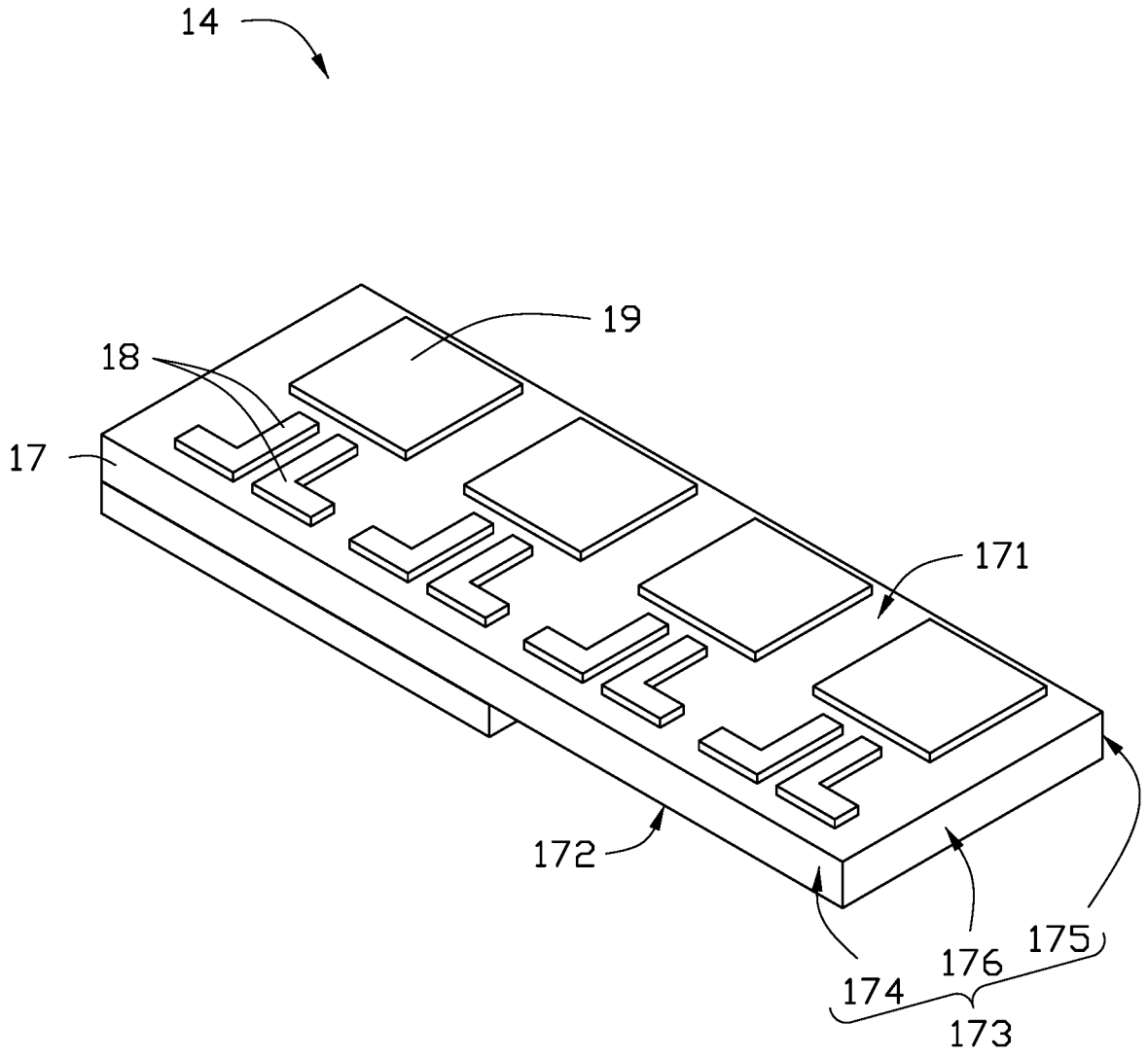
FIG. 6 is a schematic diagram of an embodiment of an antenna module of FIG. 4.

FIG. 6 illustrates that the antenna module 14 includes a substrate 17 and a plurality of first antennas 18. The first antennas 18 are arranged in a first line.

The substrate 17 includes a first surface 171 and a second surface 172, and the first surface 171 is opposite to the second surface 172.

The substrate 17 further includes a sidewall 173, and the sidewall 173 connects to the first surface 171 and the second surface 172.

The sidewall 173 includes a first sidewall 174, a second sidewall 175, and a third sidewall 176.

In at least one embodiment, the first sidewall 174 is opposite to the second sidewall 175, the first sidewall 174 is parallel to the second sidewall 175, and the third sidewall 176 is perpendicularly connected to the first sidewall 174 and the second sidewall 175.

In an embodiment, the plurality of the first antennas 18 may be disposed on the first surface 171. In other embodiment, the plurality of the first antennas 18 may be disposed inside the substrate 17 or disposed on the sidewall 173. In at least one embodiment, the substrate 17 has a rectangular structure.

In an embodiment, the antenna module 14 further includes a plurality of second antennas 19.

The second antennas 19 are arranged in a second line, and disposed on the first surface 171.

In each of the antenna modules 14, the number of first and second antennas 18 and 19 is the same. Both the first antenna 18 and the second antenna 19 are millimetric wave antennas.

The second antennas 19 arranged in a line are parallel to the first antennas 18 arranged in a straight line, and the first antennas 18 arranged in a line are parallel to the first sidewall 174.

The plurality of first antennas 18 arranged in a line are disposed adjacent to the first sidewall 174, and the plurality of second antennas 19 arranged in a line are disposed adjacent to the second sidewall 175.

In an embodiment, the first antenna 18 may be a dipole antenna, and the second antenna 19 may be a patch antenna, a micro-strip antenna, a dual-polarization antenna, or a monopole antenna.

Each of the first antennas 18 includes two monopole antennas (not shown), each of which includes a radiating element and a feeding unit.

In an embodiment, the first antennas 18 are configured to radiate signals perpendicular to the first sidewall 174 and parallel to the first surface 171, the direction of the signals is from the plurality of the first antennas 18 and away from the plurality of the second antennas 19. The direction of the signals is from the first antennas 18 and away from the plurality of the second antennas 19.

In an embodiment, the second antennas 19 are configured to radiate signals perpendicular to the first surface 171, the direction of the signals is from the plurality of the second antennas and away from the first surface 171.

The second surface 172 of the antenna modules 14 is coupled to the side surface 126 of the octagonal circuit board 12. The first sidewall 174 and the second sidewall 175 of the substrates 17 are parallel to the upper surface 122 of the octagonal circuit board 12.

In the four antenna modules 14 in the perspective of FIG. 4, two adjacent antenna modules 14 are disposed such that the first antennas 18 are located above the second antennas 19. The remaining two antenna modules 14 are disposed such that the first antennas 18 are located below the second antennas 19.

For example, as depicted in FIG. 4, the two antenna modules 14 on the right are disposed such that the first antennas 18 are located above the second antennas 19, and the two antenna modules 14 on the left are disposed such that the first antennas 18 are located below the second antennas 19. The direction of the signals of the first antennas 18 in the antenna module 14 is thus the same as that in the adjacent two antenna modules 14. This direction is opposite to the direction of the signal radiated by the first antennas 18 of the other antenna module 14 of the adjacent two antenna modules 14. This reduces the poor signal coverage of a single antenna module in the prior art.

In other embodiment, the four antenna modules 14 may be divided into two parts. A direction of the signal radiated by the first antennas 18 of the antenna module 14 of a first part is opposite to a direction of the signal radiated by first antennas 18 of the antenna module 14 of a second part. This also reduces insufficient signal coverage of a single antenna module 14.

The octagonal circuit board 12 may be a regular octagon or an irregular octagon.

In an embodiment, an angle between a direction of the signal radiated by second antennas 19 of each antenna module 14 and a direction of the signal radiated by the second antennas 19 in adjacent antenna modules 14 is in a range from 70 degrees to 110 degrees.

If the octagonal circuit board 12 is a regular octagon, the respective signal radiation directions of the second antennas 19 of an antenna module 14 and of the second antennas 19 of an adjacent antenna module 14 are perpendicular to each other.

Figure 7:
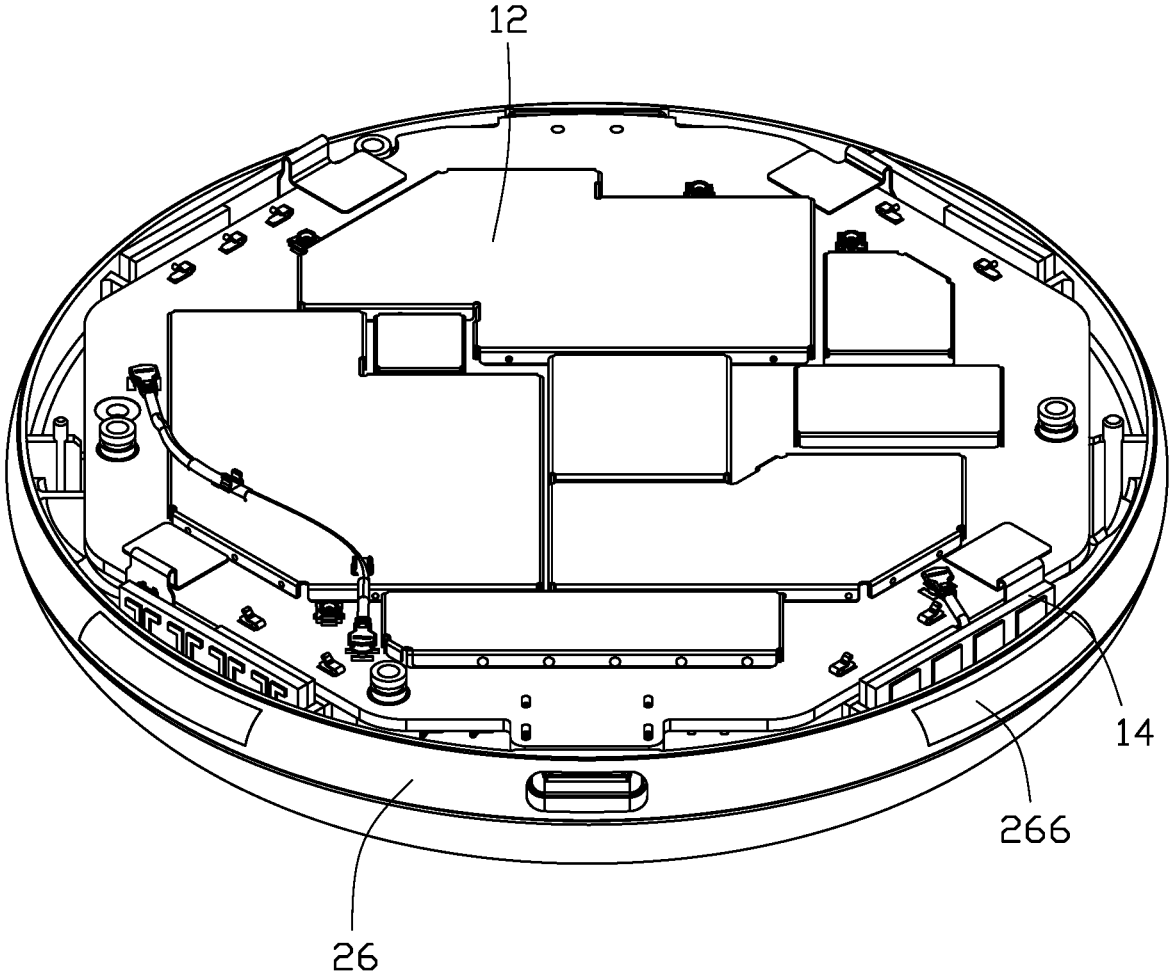
FIG. 7 is a diagram showing the antenna structure in the wireless communication device when assembled.

FIG. 7 shows the middle frame 26 as including a plurality of dielectric lenses 266.

In at least one embodiment, each of the dielectric lenses 266 is disposed to correspond to an antenna module 14. Each of the dielectric lenses 266 is configured to concentrate the radio waves of the antenna module 14, and also increase the peak gain of the antenna module 14. In the embodiment, the middle frame 26 includes four dielectric lenses 266, and the four dielectric lenses 266 are opposite to the four antenna modules 14.

In at least one embodiment, the dielectric lens 266 can be a convex inner or outer flat concave dielectric lens. The outer refers to a direction away from the antenna module 14, and the inner refers to a direction approaching the antenna module 14.

The dielectric lenses 266 or each of them can be made of materials such as ceramics, plastics, and glass, to improve the performance of the antenna module 14.

The antenna module 14 can be placed on the non-adjacent sides 126. Thereby, the signal transmission interface can be disposed on a side 126 which is in between two antenna modules 14, to avoid interference with the signal of the antenna.

Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure, comprising:

an octagonal circuit board comprising an upper surface, a lower surface, and eight side surfaces; wherein the upper surface is opposite to the lower surface, and each of the eight side surfaces is coupled to each of the upper surface and the lower surface; and four antenna modules respectively disposed on four side surfaces of the octagonal circuit board;

a plurality of dielectric lenses disposed corresponding to each of the antenna modules; wherein each of the dielectric lenses is configured to concentrate corresponding beams of the antenna modules;

wherein the four side surfaces are not adjacent to each other, and each of the antenna modules is electrically coupled to the corresponding side surface through a feeding portion; and wherein each of the antenna modules comprises a substrate, the substrate further comprises a first surface, a second surface, and a sidewall, the first surface is opposite to the second surface, the sidewall comprises a first sidewall;

wherein the second surface of the substrate is coupled to the eight side surfaces of the octagonal circuit board, and the first sidewall of the substrate is parallel to the upper surface of the octagonal circuit board.

2. The antenna structure of claim 1, wherein each of the antenna modules further comprises a plurality of first antennas, and the first antennas are arranged in a first line; wherein the sidewall is coupled to each of the first surface and the second surface; wherein the sidewall further comprises a second sidewall, and a third sidewall, the first sidewall is opposite to the second sidewall, the first sidewall is parallel to the second sidewall, and the third sidewall is perpendicularly coupled to each of the first sidewall and the second sidewall; and wherein the first antennas are disposed on the first surface, inside of the substrate, or the sidewall.

3. The antenna structure of claim 2, wherein the four antenna modules are divided into a first part and a second part, and a direction of the signal radiated by the first antennas of the antenna modules of the first part is opposite to a direction of the signal radiated by the first antennas of the antenna modules of the second part.

4. The antenna structure of claim 2, wherein each of the antenna modules further comprises a plurality of second antennas disposed on the first surface, and the second antennas are arranged in a second line; wherein the first line is parallel to the second line and the first sidewall.

5. The antenna structure of claim 4, wherein each of the first antenna is a dipole antenna, and each of the second antenna is a patch antenna, or a micro-strip antenna, or a dual-polarization antenna.

6. The antenna structure of claim 4, wherein the first antennas are configured to radiate signals perpendicular to the first sidewall and parallel to the first surface, the direction of the signals of the first antennas is from the plurality of the first antennas and away from the plurality of the second antennas; and wherein the second antennas are configured to radiate signals perpendicular to the first surface, the direction of the signals of the second antennas is from the plurality of the second antennas and away from the first surface.

7. The antenna structure of claim 6, wherein the first antennas in each of the antenna modules are configured to radiate signals in parallel directions, and in opposite directions alternately between adjacent ones of the antenna modules.

8. The antenna structure of claim 6, wherein an angle between a direction of the signal radiated by the second antennas of each of the antenna modules and a direction of the signal radiated by the second antennas in adjacent ones of the antenna module is in a range from 70 degrees to 110 degrees.

9. A wireless communication device, comprising:

a housing; wherein the housing comprises a middle frame, and an antenna structure received in the housing, and comprising:

an octagonal circuit board comprising an upper surface, a lower surface, and eight side surfaces; wherein the upper surface is opposite to the lower surface, and each of the eight side surfaces is coupled to each of the upper surface and the lower surface; and four antenna modules respectively disposed on four side surfaces of the octagonal circuit board;

a plurality of dielectric lenses arranged in the middle frame; wherein each of the dielectric lenses is disposed corresponding to each of the antenna modules, and each of the dielectric lenses is configured to concentrate corresponding beams of the antenna modules;

wherein the four side surfaces are not adjacent to each other, and each of the antenna modules is electrically coupled to the corresponding side surface through a feeding portion.

10. The wireless communication device of claim 9, wherein the wireless communication device further comprises a battery, the housing further comprises an upper cover, and a lower cover, an upper portion of the middle frame defines a first receiving portion, and the first receiving portion receives the battery; wherein a lower portion of the middle frame defines a second receiving portion, and the second receiving portion receives the antenna structure.

11. The wireless communication device of claim 10, wherein each of the antenna modules comprises a substrate and a plurality of first antennas, and the first antennas are arranged in a first line; wherein the substrate comprises a first surface, a second surface, and a sidewall, the first surface is opposite to the second surface, and the sidewall is coupled to each of the first surface and the second surface; wherein the sidewall comprises a first sidewall, a second sidewall, and a third sidewall, the first sidewall is opposite to the second sidewall, the first sidewall is parallel to the second sidewall, and the third sidewall is perpendicularly coupled to each of the first sidewall and the second sidewall; and wherein the first antennas are disposed on the first surface, inside of the substrate, or the sidewall.

12. The wireless communication device of claim 11, wherein the four antenna modules are divided into a first part and a second part, and a direction of the signal radiated by the first antennas of the antenna module of the first part is opposite to a direction of the signal radiated by the plurality of first antennas of the antenna module of the second part.

13. The wireless communication device of claim 11, wherein each of the antenna modules further comprises a plurality of second antennas disposed on the first surface, and the second antennas are arranged in a second line; wherein the first line is parallel to the second line and the first sidewall.

14. The wireless communication device of claim 13, wherein each of the first antenna is a dipole antenna, and each of the second antenna is a patch antenna, or a micro-strip antenna, or a dual-polarization antenna.

15. The wireless communication device of claim 13, wherein the first antennas are configured to radiate signals perpendicular to the first sidewall and parallel to the first surface, the direction of the signals of the first antennas is from the first antennas and away from the second antennas; and wherein the second antennas are configured to radiate signals perpendicular to the first surface, the direction of the signals of the second antennas is from the plurality of the second antennas and away from the first surface.

16. The wireless communication device of claim 15, wherein the second surface of each of the antenna modules is coupled to the side surface of the octagonal circuit board, and the first sidewall of the substrates is parallel to an upper surface of the octagonal circuit board.

17. The wireless communication device of claim 16, wherein the first antennas in each of the antenna modules are configured to radiate signals in parallel directions, and in opposite directions alternately between adjacent ones of the antenna modules.

18. The wireless communication device of claim 16, wherein an angle between a direction of the signal radiated by the second antennas of each of the antenna modules and a direction of the signal radiated by the second antennas in adjacent ones of the antenna module is in a range from 70 degrees to 110 degrees.

* * * * *